US005765920A

United States Patent [19]

Lai

[11] Patent Number: 5,765,920

[45] Date of Patent: Jun. 16, 1998

[54] HEIGHT-ADJUSTING MECHANISM FOR ARM REST OF A CHAIR

[76] Inventor: Yu-Shan Lai, No. 48, Tachuwei Tachu Village Shuishang, Chia I Hsien, Taiwan

[21] Appl. No.: 867,618

[22] Filed: Jun. 2, 1997

[51] Int. Cl.[6] ..... A47C 7/54

[52] U.S. Cl. ..... 297/411.36; 293/353; 403/105; 248/297.31

[58] Field of Search ..... 297/411.36, 353; 403/104, 105, 107, 108, 109; 248/297.31

[56] References Cited

U.S. PATENT DOCUMENTS

| | | | |
|---|---|---|---|
| 4,639,039 | 1/1987 | Donovan | 297/353 |
| 5,588,766 | 12/1996 | Loi | 297/411.36 X |
| 5,620,233 | 4/1997 | Corwin | 297/411.36 |
| 5,649,741 | 7/1997 | Beggs | 297/411.36 X |

*Primary Examiner*—Peter R. Brown
*Attorney, Agent, or Firm*—Browdy and Neimark

[57] ABSTRACT

An improved height-adjusting mechanism for use on armrest of a chair. It includes a securing mount having a central sliding slot provided with a plurality of consecutively spaced slant retaining recesses on one side of the slot; and an adjusting member slidably engaged with the securing mount, an abutment block movably confined in a rectangular cavity of the adjusting member, a resilient plate and a positioning piece. A bolt secured to the abutment block is selectively engaged with one of the slant recesses of the securing mount when the adjusting member is moved in one way and the locking bolt can be freed of the restraint of the retaining recesses and held by the positioning piece when the abutment member first reaches the top of the securing mount and then is pushed all the way down to the bottom of the securing mount for adjustment when the adjusting member is moved in another way or upwardly.

1 Claim, 4 Drawing Sheets

HEIGHT-ADJUSTING MECHANISM FOR ARM REST OF A CHAIR

BACKGROUND OF THE INVENTION

The present invention relates to an improved height-adjusting mechanism for use on armrest of a chair. It includes a securing mount having a central slot provided with a plurality of consecutively spaced slant retaining recesses on one side of the slot; and an adjusting member slidably engaged with the securing mount, an abutment block movably confined in a rectangular cavity of the adjusting member, a symmetrically bent resilient plate and a positioning means. A bolt secured to the abutment block is selectively engaged with one of the slant recesses of the securing mount when the adjusting member is moved upwardly and the bolt can be freed of the restraint of the recesses and held by the positioning means when the abutment member is first pulled to the top of the securing mount and then is pushed all the way down to the bottom of the securing mount for adjustment when the adjusting member is next moved in another way or upwardly.

Modern furniture are designed with many facilities to make people of different physical sizes comfortable when using them. For instance, chairs are provided with adjustable armrests so that people can put their arms on the armrests with comfort regardless of their physical sizes. Conventional height adjusting mechanisms of chairs are associated with the following disadvantages:

1. In prior art adjusting mechanisms, a person must use one hand to operate on a lever arm to release a retaining means from a securing mount for effecting adjustment the height of the armrest, after the adjustment, the lever arm is freed to make the retaining means to be fixed in place again. Such adjustment is relatively complex and inconvenient.
2. Such a prior art needs not only a securing mount and an adjusting device but also a retaining means to effect fixing purpose, making the assembly relatively complex in one aspect and increase the production cost in another aspect.

SUMMARY OF THE INVENTION

The primary object of the present invention is to provide an improved height adjusting mechanism for armrest of a chair which is easy to operate in adjustment and simple in structure so as to make the production cost thereof low and the assembly easy.

DETAILED DESCRIPTION OF THE PREFERRED EMBODIMENT

Figure 1:
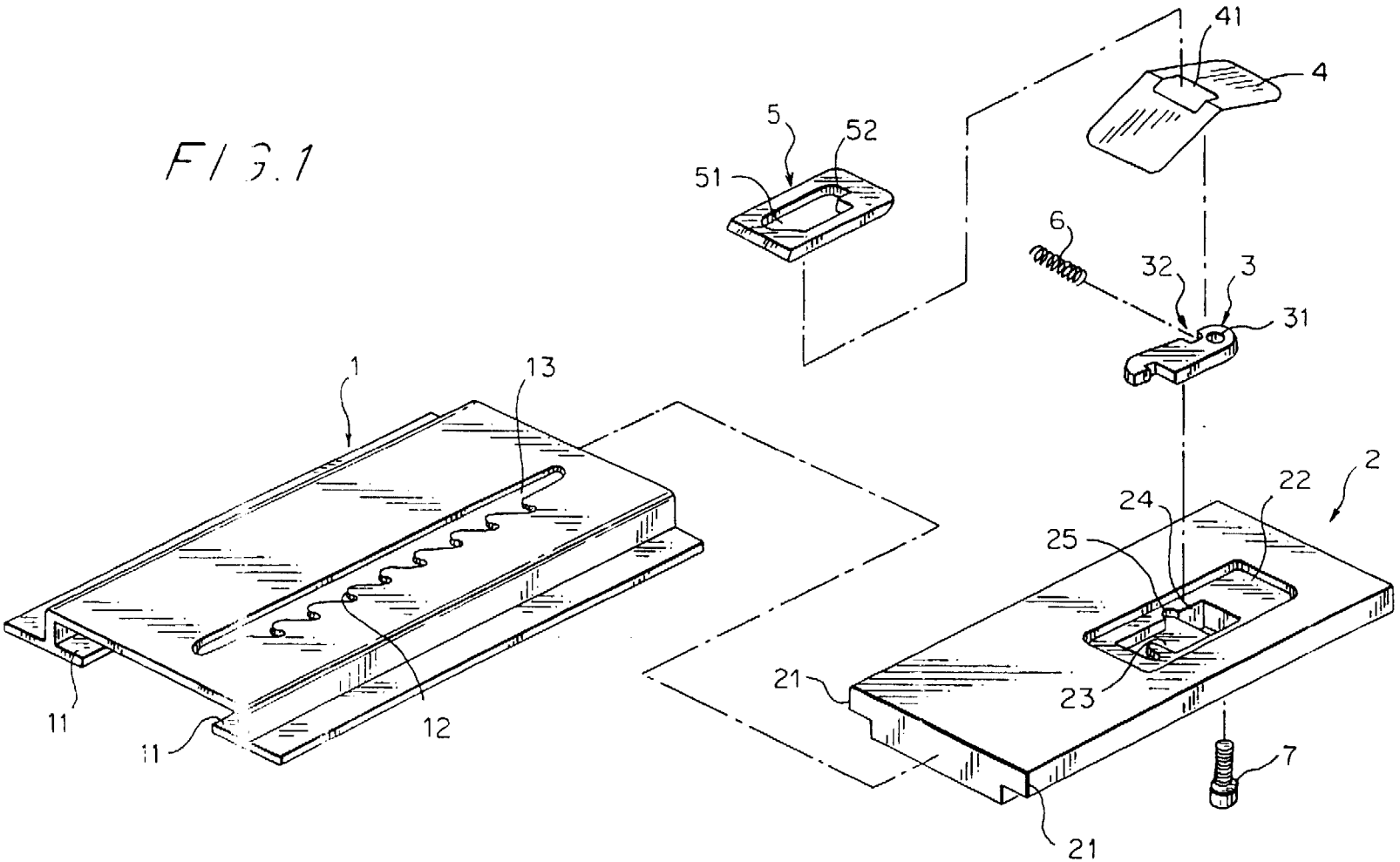
FIG. 1 perspective diagram showing the exploded components of the present invention.

Referring to FIG. 1, the height adjusting mechanism for armrest of a chair of the present invention is comprised of a securing mount 1, an adjusting member 2 , an abutment block 3, a resilient plate 4, a positioning means 5, a bias spring 6, and a locking bolt 7.

The securing mount 1 is of a rectangular shape with the longitudinal edges thereof downwardly bent and a horizontal plate 10 is secured to each bent edge in a symmetric manner so as to form a pair of inner track flanges 11. A longitudinally extended slide slot 13 defined at the center of the rectangular securing mount 1 having one side thereof provided with a plurality of consecutively spaced wavy retaining recesses 12. Each end of the slide slot 13 extending further a distance beyond the end wavy retaining recesses 12.

The adjusting member 2 of a rectangular shape having a sliding wing 21 along each longitudinal edge thereof is slidably engaged with one of the inner track flanges 11 of the securing mount 1. A rectangular cavity 22 is disposed at the top of the adjusting member 2. A through hole 24, a vertical receiving recess 25 and an abutment groove 23 are disposed in the rectangular cavity 22.

The abutment block 3 movably located in the abutment groove 23 has a bolt hole 31 at one end with a recess 32 in correspondence to the vertical receiving recess 25 of the rectangular cavity 22.

The resilient plate 4 is symmetrically bent with a central opening 41. The positioning means 5 has an inner opening 51 with are receiving corner 52 defined at one end of the inner opening 51.

The abutment block 3 is disposed in the abutment groove 23 of the adjusting member 2 and a bias spring 6 is disposed in a space defined by the vertical recess 25 of the adjusting member 2 and the recess of the abutment block 3 so as to permit the abutment block 3 to be movably confined in the abutment groove 23 and be retracted to its original position by the bias spring 6.

Afterwards, the resilient plate 4 is disposed on top of the abutment block 3 and inside the rectangular cavity 22 with the central opening 41 located in alignment with the bolt hole of the abutment block 3. The positioning means 5 is placed on top of and in abutment against the resilient plate 4 with the receiving corner 52 and the retaining recesses 12 of the positioning means 5 all pointing to the left. Afterwards, the positioning means 5 and the resilient plate 4 are both pressed downwardly to render the adjustment member 2 to be housed under the securing mount 1 with the sliding wings 21 of the adjustment member 2 engaged with the inner track flanges 11 of the securing mount 1.

Figure 2:
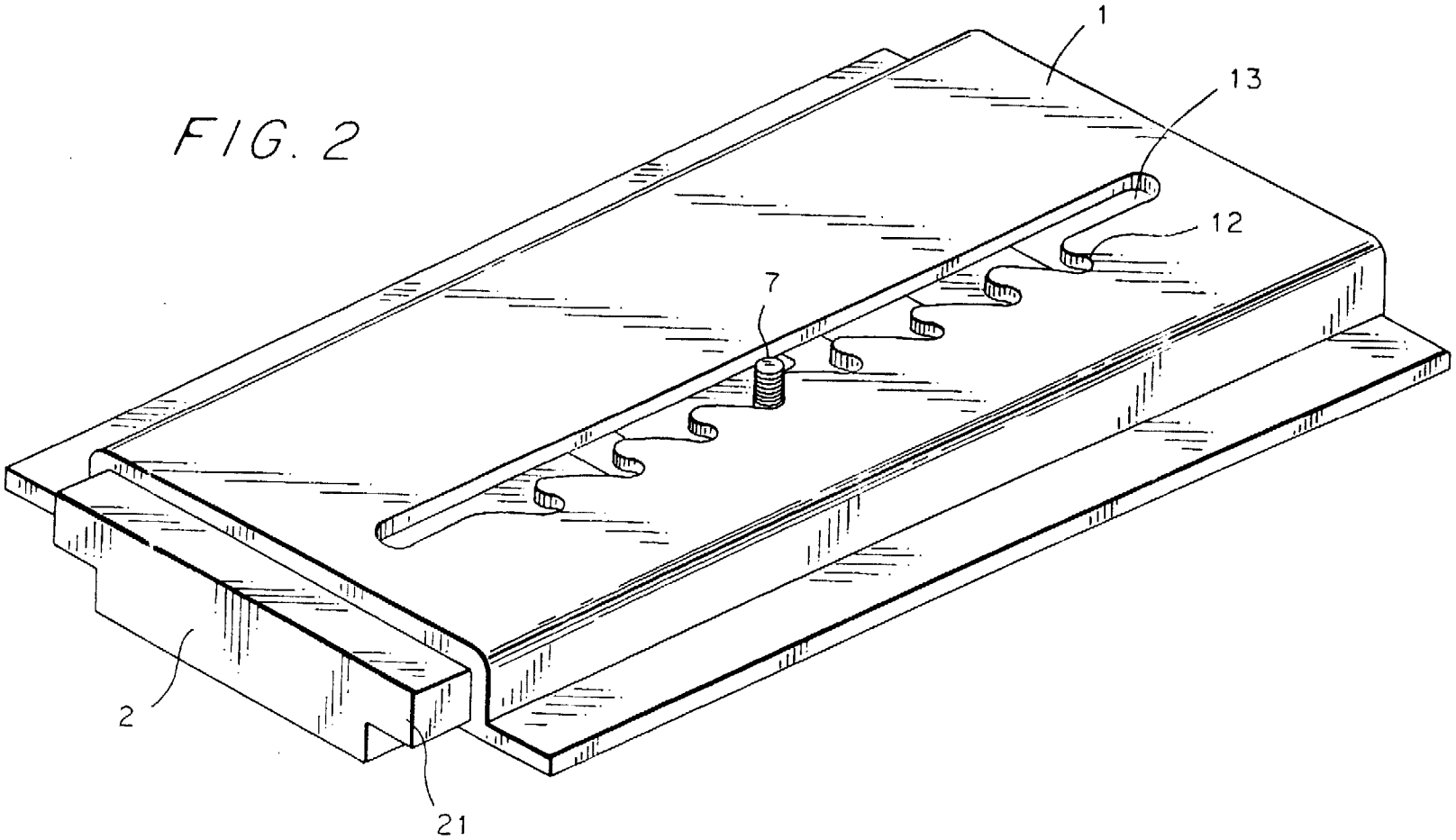
FIG. 2 is a diagram showing the assembly of the present invention.

Next, the locking bolt 7 led through the through hole 24 of the adjustment member 2 is engaged with the bolt hole 31 of the abutment block 3 and is finally in registration with one of the slant recesses 12 of the securing mount 1. Then, the adjustment member 2 is fixed to an armrest of a chair, as shown in FIG. 2. In practical operation, the positioning means 5 is confined in the rectangular cavity 22 due to its small size. The bottom side of the positioning means 5 abuts against only the protruded top of the bent resilient plate 4, having less frictional force than the top side thereof which is fully in frictional contact with the inner side of the securing mount 1 as a result of a natural urging of the resilient plate 4. So, when the adjusting member 2 is moved relatively with respect to the securing mount 1, the positioning means 5 is affected by the frictional force in such a manner that the locking bolt 7 can be controlled with the help of the positioning means 5 and the bias spring 6 to selectively engage with the retaining recesses 12.

Figure 3A:
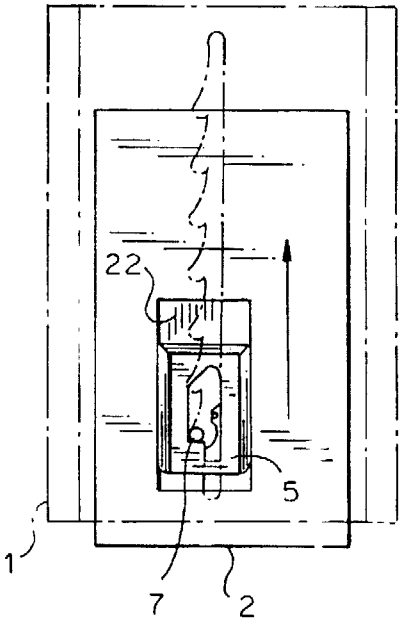
FIGS. 3A, 3B, 3C are consecutive diagrams showing the relative upward movements of the adjusting member with respect to the securing mount.
Figure 3B:
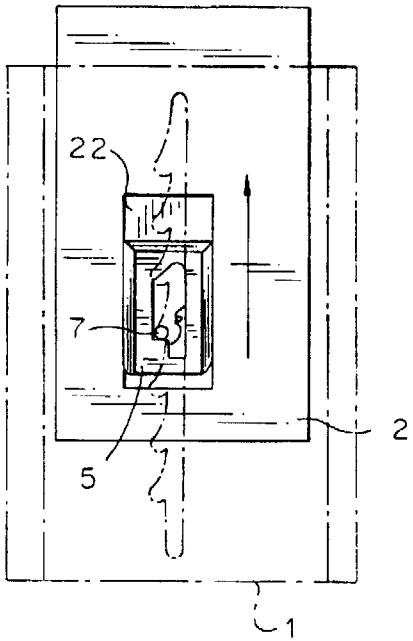
Figure 3C:
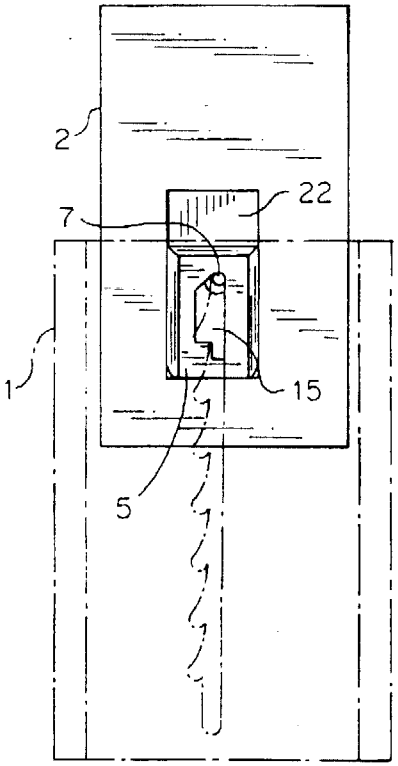

The detailed control of the locking bolt 7 is explained as follows. When the adjusting member 2 is pulled upwardly, as shown in FIGS. 3A, 3B, 3C, the locking bolt 7 is moved out of or away from one retaining recess 12 and in smooth contact with the wavy contour of the consecutive retaining recesses 12 and falls into registration with the next retaining recess 12 one by one as a result of the actuation of the bias spring 6 on the abutment block 3 to which the locking bolt 7 is secured so as to make the height of an armrest of a chair fixed to the adjusting member 2 varied.

Figure 4A:
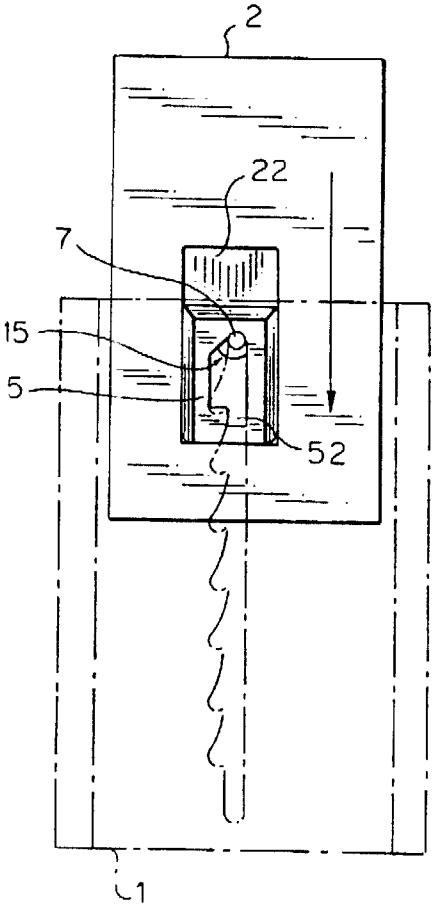
FIGS. 4A, 4B, 4C are consecutive diagrams showing the bolt being accommodated in the receiving comer of the positioning means for adjustment when the adjusting member is pushed down to the bottom and then pulled upwardly step by step to let the locking bolt engaged with the retaining recesses one by one.
Figure 4B:
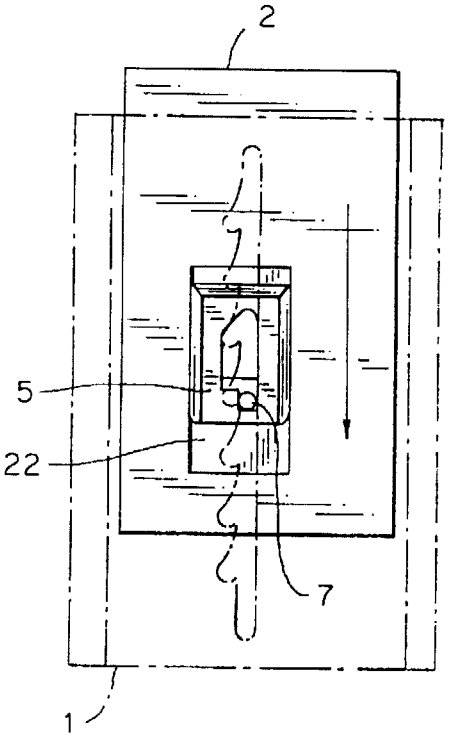
Figure 4C:
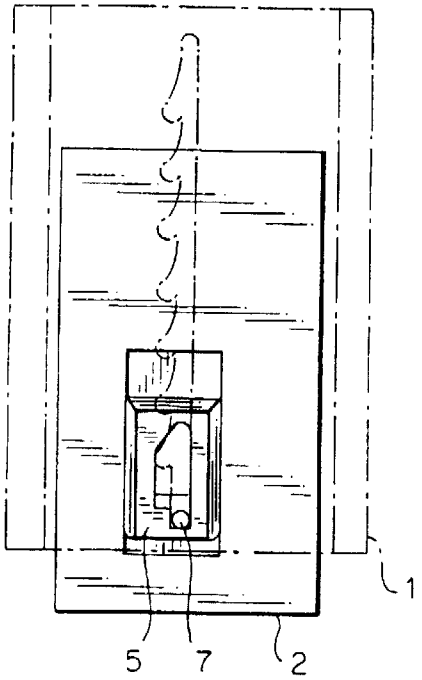

Referring to FIGS. 4A, 4B, 4C, when the adjusting member 2 is pushed downwardly to lower down the armrest of a chair, the adjusting member 2 is first pulled to its topmost limit with respect to the securing mount 1 to bring the locking bolt 7 to the top corner of the central sliding slot 13. Afterward, the adjusting member 2 is pushed downwardly again. The top side of the positioning means 5 is subject to a larger frictional force .in contact with the inner side of the securing mount 1, than the the bottom side in abutment against the bent resilient plate 4. So, the positioning means 5 slidable in the rectangular cavity 22 is approximately held in place when the adjusting member 2 is moved, resulting in the locking bolt 7 to fall into the receiving corner 52 of the positioning means 5 with the guidance of the central sliding slot 13. Thus, the locking bolt 7 can not be engaged with the retaining recesses 12 at then.

In such a manner that the the adjusting member 2 can be moved all the way down to the bottom of the securing mount 1, as shown in FIG. 4C. Once again, as the adjusting member 2 is pulled upwardly, the positioning means 5 is also temporarily remained in place due to frictional force, so the locking bolt 7 is freed from the receiving corner 52 of positioning means 5 and is pushed into engagement with the retaining recesses 12 one by one by the bias spring 6, effecting the variation of the height adjustment of the armrest of a chair.

I claim:

1. A height adjusting mechanism for armrest of a chair, comprising: a securing mount, an adjusting member, an abutment block, a resilient plate, a positioning means, a bias spring, and a locking bolt; said securing mount of a rectangular shape with the axial edges thereof downwardly bent and a horizontal plate being secured to each said bent edge in a symmetric manner so as to form a pair of inner track flanges; a longitudinally extended slide groove defined at the center of said rectangular securing mount having one side thereof provided with a plurality of consecutive spaced slanted retaining recesses; each end of said slide groove extending further beyond said slanted retaining recesses; said height adjusting mechanism being characterized by that said adjusting member of a rectangular shape having a sliding flange at each longitudinal edge thereof,and a rectangular cavity being disposed at an upper surface thereof, a through hole and a vertical recess and an abutment groove being disposed in said rectangular cavity; said abutment block movably located in said abutment groove having a bolt hole defined at one end with a recess in correspondence to said vertical recess of said rectangular cavity; said resilient plate being symmetrically bent with a central opening; said positioning means having an inner opening with a receiving corner defined at one end of said inner opening; said abutment block being disposed in said abutment groove of said adjusting member; and a spring being disposed in a space defined by said vertical recess of said adjusting member and said recess of said abutment block so as to pennit said abutment block to be movably confined in said abutment groove and be retracted to its original position by said spring; afterwards, said resilient plate being disposed on top of said abutment block and inside said rectangular cavity thereof with said central opening located in alignment with said screw hole of said abutment block; said positioning means being located on top of said resilient plate with said receiving corner thereof pointing to the same direction as that of the opening of each of said consecutively spaced slanted retaining recesses of said securing mount so as to permit said adjusting member to be slidably engaged with said securing mount; said locking bolt passing said through hole of said adjusting member and engaged being with said bolt hole of said abutment block with part of said locking bolt extended out so as to selectively engage with one of said consecutively spaced slanted retaining recesses one by one when said adjusting member which is adapted to be secured to the armrest of a chair, is pulled upwardly; whereby, in order to push said adjusting member downwardly for adjustment, said adjusting member is first pulled to the topmost end of said sliding slot of said securing mount with said locking bolt abutting against the end of said sliding slot, then said adjusting member is pushed downwardly; the underside of said positioning means being in partial abutment against the protruded top of the bent resilient plate, and the top side of said positioning means in full contact with the inner side of said securing mount, and being subject to a larger frictional force than the underside thereof; due to the difference between said frictional force on said top side and underside of said positioning means, said positioning means being slidable in said rectangular cavity of said adjusting member whereby when said adjusting member is pulled upwardly again, said positioning means has its upper surface subject to a larger frictional force and is retained in position temporarily, said locking bolt guided a by said sliding slot of said securing mount is directed into said receiving corner of said positioning means so as to permit said adjusting member to move downwardly in a direction against the opening of said consecutively spaced slanted retaining recesses to the bottom end of said securing mount; afterwards, said adjusting member is pulled upwardly with respect to said securing mount to release said locking bolt from said receiving corner of said positioning means and engage with said retaining recesses one by one with the help of said bias spring for effecting the adjustment of height of said armrest of a chair.

* * * * *